US009643810B2

(12) United States Patent
Seki

(10) Patent No.: US 9,643,810 B2
(45) Date of Patent: May 9, 2017

(54) STACKER FOR STORING DOCUMENTS

(71) Applicant: Japan Cash Machine, Co., Ltd., Osaka (JP)

(72) Inventor: Toru Seki, Tokyo (JP)

(73) Assignee: Japan Cash Machine Co., Ltd., Osaka (JP)

( * ) Notice: Subject to any disclaimer, the term of this patent is extended or adjusted under 35 U.S.C. 154(b) by 0 days.

(21) Appl. No.: 15/021,716

(22) PCT Filed: Sep. 9, 2014

(86) PCT No.: PCT/JP2014/004626

§ 371 (c)(1),
(2) Date: Mar. 14, 2016

(87) PCT Pub. No.: WO2015/037224

PCT Pub. Date: Mar. 19, 2015

(65) Prior Publication Data

US 2016/0221786 A1 Aug. 4, 2016

(30) Foreign Application Priority Data

Sep. 13, 2013 (JP) ..... 2013-190098

(51) Int. Cl.
*B65H 29/46* (2006.01)
*G07D 11/00* (2006.01)
(Continued)

(52) U.S. Cl.
CPC ..... *B65H 29/46* (2013.01); *B65H 31/04* (2013.01); *B65H 31/06* (2013.01); *G07D 11/0012* (2013.01); *B65H 2701/1912* (2013.01)

(58) Field of Classification Search
CPC ..... B65H 29/46; B65H 31/06; B65H 31/12; B65H 31/14; B65H 31/18; G07D 11/0012
(Continued)

(56) References Cited

U.S. PATENT DOCUMENTS 3,655,186 A 4/1972 Bayha
5,372,361 A 12/1994 Isobe et al.
(Continued)

FOREIGN PATENT DOCUMENTS

EP 0 967 165 A2 12/1999
JP 5428496 2/1979
(Continued)

OTHER PUBLICATIONS

International search report for Application No. PCT/JP2014/004626 dated Sep. 25, 2014.
(Continued)

*Primary Examiner* — David H Bollinger
(74) *Attorney, Agent, or Firm* — Bachman & LaPointe, PC

(57) ABSTRACT

The stacker comprises a pair of protrusions 6 prominent from side walls 5 in a spaced relation to each other to form a second opening 7 between protrusions 6, an interim chamber 13 defined by partitions 3 and protrusions 6, and a pair of inner surfaces 8 formed on protrusions 6 prominent into interim chamber 13 from side walls 5 more inward than side surfaces of a holding chamber 12. Largely deviated one of side edges of document D comes into contact to inner surface 8 in interim chamber 13 to push document D inward by projection of inner surface 8 to store document D in a vault 30 with the tolerable deviation upon stowage of a subsequent document D.

10 Claims, 10 Drawing Sheets

(51) Int. Cl.
*B65H 31/04* (2006.01)
*B65H 31/06* (2006.01)

(58) Field of Classification Search
USPC ..... 271/180, 181
See application file for complete search history.

(56) References Cited

U.S. PATENT DOCUMENTS

| | | | | |
|---|---|---|---|---|
| 5,709,525 | A * | 1/1998 | Marzullo | B65H 29/46 271/181 |
| 6,241,240 | B1 * | 6/2001 | Bukhman | B65H 29/46 271/181 |
| 6,585,260 | B1 | 7/2003 | Izawa et al. | |
| 6,648,325 | B1 * | 11/2003 | Mays | B65H 29/46 271/177 |
| 7,886,888 | B1 * | 2/2011 | Chien | B65H 29/46 194/206 |
| 8,167,301 | B2 * | 5/2012 | Nireki | B65H 29/46 271/180 |
| 8,276,734 | B2 | 10/2012 | Nago et al. | |
| 8,763,779 | B2 * | 7/2014 | Nireki | G07F 19/202 194/206 |
| 2003/0214095 | A1 * | 11/2003 | Allen | B65H 29/22 271/177 |
| 2005/0189702 | A1 * | 9/2005 | Takeuchi | B65H 29/18 271/180 |
| 2011/0114441 | A1 | 5/2011 | Seki et al. | |

FOREIGN PATENT DOCUMENTS

| | | |
|---|---|---|
| JP | 5441695 | 3/1979 |
| JP | 57081050 A | 5/1982 |
| JP | 60180079 | 11/1985 |
| JP | 05314342 | 11/1993 |
| JP | 08040619 A | 2/1996 |
| JP | 2001357432 A | 12/2001 |
| TW | 298747 | 10/2006 |
| TW | 201115508 | 5/2011 |

OTHER PUBLICATIONS

Taiwan Office action for Application No. 103130561 dated Sep. 13, 2013.

European search report for Application No. 14844099.3-1731 dated Feb. 10, 2017.

* cited by examiner

STACKER FOR STORING DOCUMENTS

TECHNICAL FIELD IN INDUSTRY

This invention relates to a stacker that may store all documents in a tolerable deviation within the stacker.

PRIOR ART

For example, Patent Document 1 listed below shows a bill stacker that may stow bills arranged in a standby chamber into a storage. This stacker comprises a generally rectangular case, a pair of support plates secured to an inside of the case, a backup plate urged by a pair of coiled springs toward each bottom of the support plates, a pusher disposed above the case for vertical movement, and a solenoid for moving the pusher between an upper position above the case and a lower position beneath the support plates through an opening formed between the support plates. When a bill is supplied on the support plates, the pusher moves from the upper to the lower position through the opening against resilience of the springs by the activation of the solenoid to stow the bill into the storage formed under the support plates. Upon deactivation of the solenoid, the resilient force of the springs causes the pusher to return to the upper initial position from the lower position, and simultaneously, the backup plate move toward the bottom surfaces of the support plates to hold the bill between the backup plate and bottom of the support plates.

Patent Document 2 indicates an application of the mechanism shown in Patent Document 1 wherein a bill handling apparatus comprises a bill validator for validating authenticity of an inserted bill and inward transporting the bill decided as genuine, a bill stacker attached to the bill validator for storing the genuine bill transported from the bill validator, and a conveyer for transporting the genuine bill to the bill stacker. The conveyer may continually transport and store a plurality of bills in the bill stacker from the bill validator. The bill handling apparatus is disadvantageous that sometimes a bill may be transported by the conveyor with deviation in the bill stacker when the decentered bill has been inserted into the bill validator. In this case, the bill turns out to be eccentrically transported to and directly stowed in the bill stacker for example in the inclined or misaligned condition of the bill. When an operator takes out a number of stacked non-aligned bills from the bill stacker, sometimes he or she may fail to safely catch the bills by their hand, then may drop and scatter them on a floor.

Patent Document 3 shows a bill validator with an aligning device for centering a bill inserted into an inlet on a longitudinal central axis of a bill passageway before a validation sensor in the validator. The aligning device has a pair of centering members arranged on the opposite sides of bill passageway for lateral movement toward and away from each other, and a drive motor for reciprocating the centering members toward and away from each other. When the drive motor moves the centering members toward each other, a bill between the centering members is centralized to center the bill so as to bring the bill's central line into alignment with the passageway's central line. In this case, when centered bill produces greater warpage resistance than an inherent holding torque of the drive motor, it comes to stall and stop defeated by the bill's warpage resistance, and then the drive motor is adversely rotated to return the centering members to their extreme position.

PRIOR ART DOCUMENTS

[Patent Document 1] U.S. Pat. No. 3,655,186
[Patent Document 2] U.S. Pat. No. 5,372,361
[Patent Document 3] U.S. Pat. No. 8,276,734

SUMMARY OF THE INVENTION

Problem to Be Solved by the Invention

The centering device shown in Patent Document 3 is advantageous that it may center a bill whose the central line can go into alignment with the passageway's longitudinal central line in the validator, but it is adverse that it requires a longer passageway for accommodating the centering device and that the bill's inlet is designed to be projected forward. This structure will lead to boost up the cost in manufacture and make it impossible to mount the centering device in a bill validator of the limited or shortened outer configuration.

An object of the present invention is to provide a stacker that may receive all the documents in a tolerable deviation within the stacker even if the decentered documents are supplied. Another object of the invention is to provide a stacker capable of storing documents in a storage with the documents approximately in alignment with the storage without a centering device.

Means for Solving the Problem

The stacker according to the present invention comprises: a case (1) having a pair of side walls (5), a pair of partitions (3) secured to side walls (5) in a spaced relation to each other to form a first opening (4) between partitions (3), a holding chamber (12) defined behind partitions (3), a vault (30) defined between side walls (5) before partitions (3), a pusher (11) movable between an initial position behind holding chamber (12) and a pushed position in vault (30), an actuator (14) driven for moving pusher (11) between the initial and pushed positions, a backup plate (9) movably received in vault (30), a pair of protrusions (6) prominent from side walls (5) in a spaced relation to each other to form a second opening (7) between protrusions (6), a spring (10) disposed in vault (30) for resiliently urging backup plate (9) toward protrusions (6), an interim chamber (13) defined by partitions (3) and protrusions (6), and a pair of inner surfaces (8) formed on protrusions (6) prominent into interim chamber (13) from side walls (5) more inward than side surfaces of holding chamber (12). Actuator (14) is driven to move pusher (11) from the initial to pushed positions to stow a document (D) from holding chamber (12) into vault (30) through holding chamber (12), first opening (4), interim chamber (13) and second opening (7) to sandwich the document (D) between protrusions (6) and backup plate (9). When a document (D) is arranged in a highly eccentric position of holding chamber (12), a largely deviated side edge of the document (D) comes into contact to and moved inward by one of inward projected surfaces (8) in interim chamber (13) to entirely store the document (D) into vault (30) upon stowage of a subsequent document (D).

Effect of the Invention

The stacker may receive all documents in the vault with tolerable deviation of the documents to easily and safely take out them from the vault.

BEST MODE FOR CARRYING OUT THE INVENTION

Figure 1:
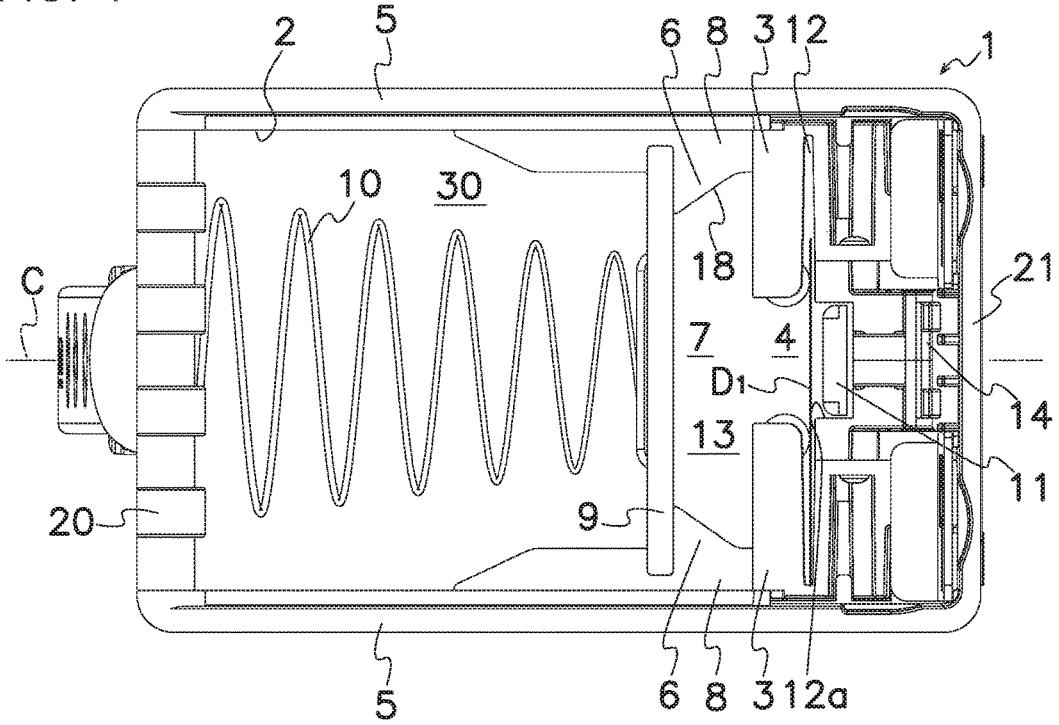
FIG. 1 A sectional view of the stacker according to the present invention indicating a bill supplied in a decentered position of a holding chamber.
Figure 2:
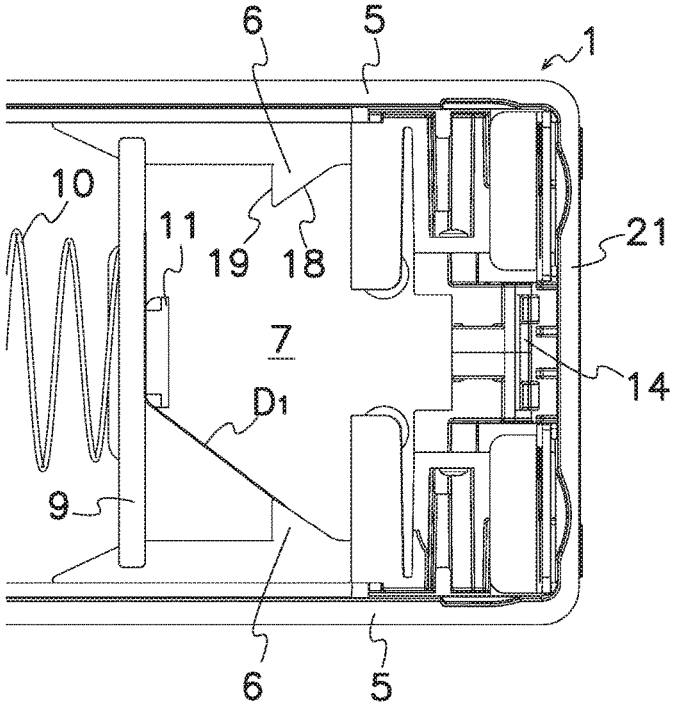
FIG. 2 A sectional view with a pusher moved from an initial position to a pushed position.
Figure 3:
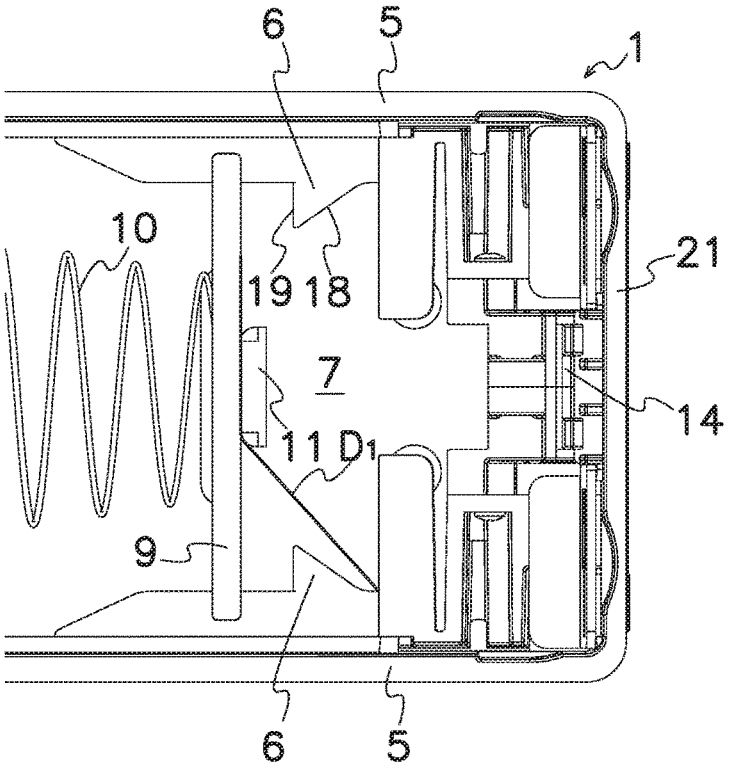
FIG. 3 A sectional view with the pusher slightly returned from the pushed position toward the initial position.
Figure 4:
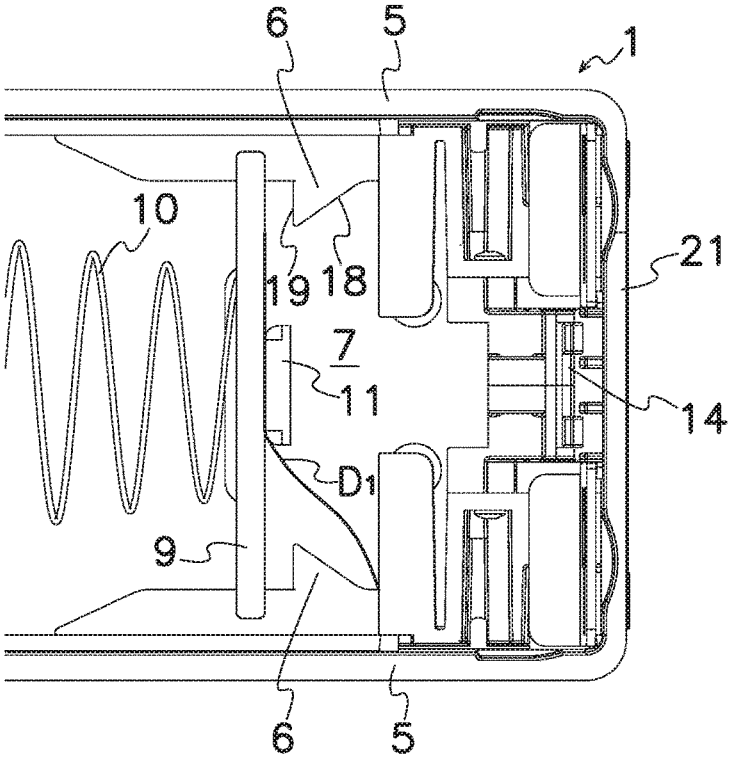
FIG. 4 A sectional view with the pusher further returned toward the initial position from FIG. 3.

The term "documents" herein broadly means all or any of valuable papers or cards including bills, banknotes or paper currencies, admission tickets, coupon tickets and credit cards, while the embodiments of the invention will be described hereinafter in connection with FIGS. 1 to 20 of the drawings on the stacker for storing bills as documents.

A case 1 forms a shell integrally made of resin or metallic panels for the stacker to define an inner cavity 2 by a pair of parallel side walls 5, a front wall 20 connected to each front end of side walls 5, a back wall 21 disposed in parallel to front wall 20 and connected to each back end of side walls 5, top and bottom walls (not shown) connected to top and bottom ends of side, front and back walls 5, 20, 21. Inner cavity 2 has a front space for forming a vault 30 to store bills, and as in Patent Document 2, the top wall provides a lid rotatably attached to front wall 20 between opened and closed positions.

The stacker further comprises a pair of partitions 3 secured to side walls 5 in a spaced relation to each other to form a first opening 4 between partitions 3, a holding chamber 12 formed behind partitions 3, a vault 30 formed between side walls 5 before partitions 3, a pusher 11 movable between an initial position behind holding chamber 12 and a pushed position in vault 30, an actuator 14 driven for moving pusher 11 between the initial and pushed positions, a backup plate 9 disposed within vault 30 for parallel movement of backup plate 9 to the moved direction of pusher 11, a pair of protrusions 6 prominent from side walls 5 for forming rear ends of vault 30, a second opening 7 formed between protrusions 6 in a spaced relation to each other, a spring 10 disposed in vault 30 for resiliently urging backup plate 9 toward protrusions 6, an interim chamber 13 defined by partitions 3 and protrusions 6, and a pair of inner surfaces 8 formed on protrusions 6 prominent into interim chamber 13 from side walls 5 more inward than side surfaces of holding chamber 12.

A pair of partitions 3 is secured to inside surfaces of side walls 5 of case 1 in front of and in a spaced relation to back wall 21 to define holding chamber 12 between partitions 3 and back wall 21. As shown in US2011/0114441, a bill is supplied into holding chamber 12 through a slit (not shown) formed in the top wall from outside of case 1.

Formed behind and connected to holding chamber 12 and in mirror image symmetry with respect to a longitudinal central surface C of case 1 is a recess 12*a* that accommodates pusher 11 and actuator 14 for driving pusher 11. FIG. 1 illustrates pusher 11 at the initial position in recess 12*a* to move pusher 11 back and forth between the initial and pushed positions (FIGS. 1 and 2) respectively inside and outside of recess 12*a*. Detailed structure of actuator 14 for moving pusher 11 is disclosed for example in U.S. Pat. No. 6,585,260.

A pair of protrusions 6 is secured to inside of side walls 5 in a spaced relation to each other on opposite sides of longitudinal central surface C of case 1 to form a second opening 7 between protrusions 6. An interim chamber 13 is formed between each of partitions 3 and each of protrusions 6, and inner surfaces 8 are protruded respectively into interim chamber 13 from side walls 5. Holding chamber 12, first opening 4, interim chamber 13 and second opening 7 are arranged in a parallel line to a moving direction of pusher 11 and formed in mirror image symmetry with respect to longitudinal central surface C of case 1.

Interim chamber 13 is formed between inner surfaces 8 with the width narrower than holding chamber 12, and second opening 7 has the width greater than first opening 4. Protrusions 6 have inner surfaces 8 formed with a pair of tapered surfaces 18 converging toward vault 30, and each front of protrusions 6 forms a pair of support surfaces 19 that backup plate 9 rests on. Vault 30 may receive backup plate 9 movable back and forth within vault 30 and spring 10 for resiliently urging backup plate 9 toward support surfaces 19 of protrusions 6. Backup plate 9 is in direct contact to support surfaces 19 of protrusions 6 by resilience force of spring 10 without bills in vault 30.

When bill D is disposed in holding chamber 12 with bill D whose central axis is in alignment with or slightly deviated from a longitudinal central surface C of case 1, whole of bill D with its side edges can pass at one time through all of first opening 4, interim chamber 13 and second opening 7 upon movement of pusher 11 to the pushed position in vault 30 by actuator 14. Then, when pusher 11 is returned to the initial position, resilience of spring 10 moves backup plate 9 toward protrusions 6 while both side edges of bill D come to correctly and firmly be held between each of projections 6 and backup plate 9.

When a first bill $D_1$ is disposed in holding chamber 12 with first bill $D_1$ whose central axis is considerably deviated or largely decentered from longitudinal central surface C of case 1, actuator 14 is driven to move pusher 11 to the pushed position, and the only one side edge of first bill $D_1$ that is nearer longitudinal central surface C can first pass through first opening 4, interim chamber 13 and second opening 7. Then, when pusher 11 is returned to the initial position (FIG. 5), the one side edge of first bill D1 is sandwiched between each support surface 19 of projections 6 and backup plate 9, but the other side edge of first bill $D_1$ off longitudinal central surface C fails to pass through second opening 7 and stays in interim chamber 13 while is pushed by nearby inner surface 8 and moves slightly inward.

Figure 5:
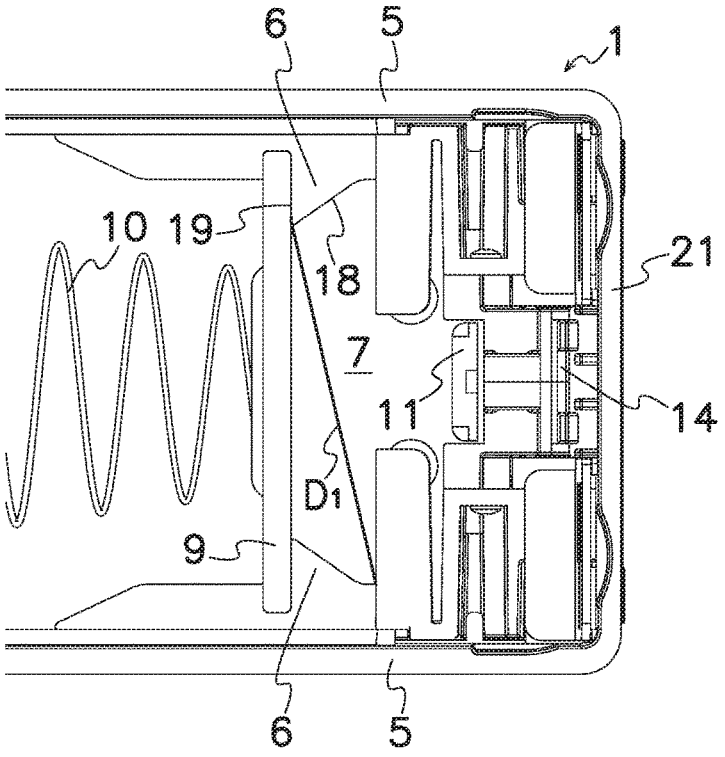
FIG. 5 A sectional view indicating a half-stored state of a bill whose one side edge is held in a vault while the other side edge of the bill still remains in an interim chamber when the pusher is returned to the initial position.

Then, when pusher 11 is returned to the initial position, the one side edge of first bill $D_1$ comes to be sandwiched between nearby support surface 19 of projection 6 and backup plate 9, but the other side edge of first bill $D_1$ still remains in interim chamber 13 to establish a half-stored state of first bill $D_1$ (FIG. 5). The other side edge of first bill $D_1$ is in contact to inner surfaces 8 that pushes first bill $D_1$ slightly inward to reduce the eccentric distance between the central axis of first bill $D_1$ and longitudinal central surface C of case 1 by the projection of inner surfaces 8.

Figure 6:
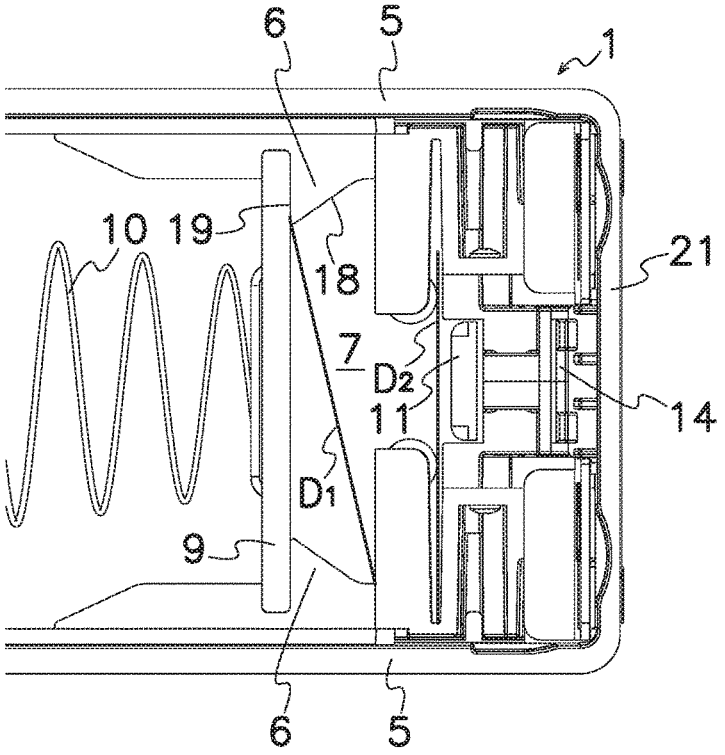
FIG. 6 A sectional view indicating a subsequent bill arranged in the holding chamber of FIG. 5.
Figure 7:
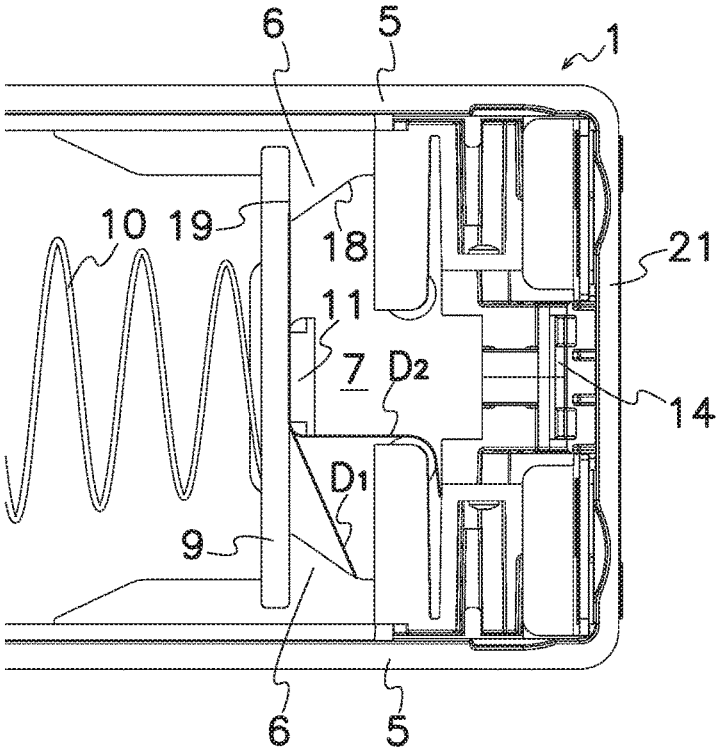
FIG. 7 A sectional view with the subsequent bill in FIG. 6 pushed toward the pushed position by the pusher.
Figure 8:
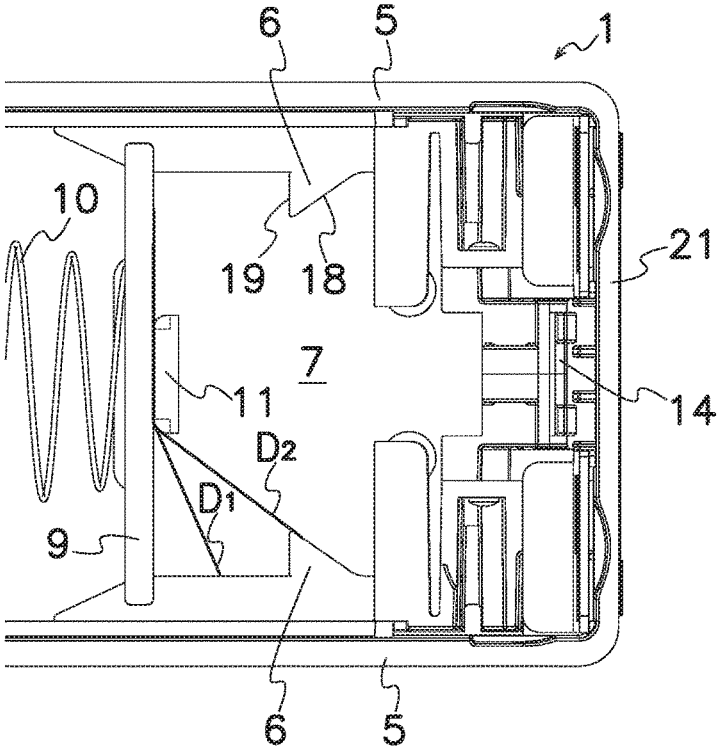
FIG. 8 A sectional view with two bills in FIG. 7 moved to the pushed position by the pusher.

As shown in FIG. 6, first bill $D_1$ is in the half-stored state with the other side edge slightly moved inward by the projection of inner surface 8. After that, a subsequent second bill $D_2$ is supplied into holding chamber 12 and actuator 14 is operated to move pusher 11 to stow second bill $D_2$ toward vault 30 as shown in FIGS. 7 and 8 to allow first bill $D_1$ to certainly pass through second opening 7 free from catching by nearby tip of protrusion 6. And when actuator 14 is operated to return pusher 11 from the pushed to the initial position as shown in FIGS. 9 to 12, resilient force of spring 10 elastically urges backup plate 9 toward pusher 11 to sandwich both first and second bills $D_1$, $D_2$ between backup plate 9 and pusher 11 and to move them toward protrusions 6. Then, backup plate 9 is brought into contact to support surfaces 19 of projections 6 when pusher 11 is fully returned to the initial position by actuator 14.

Figure 9:
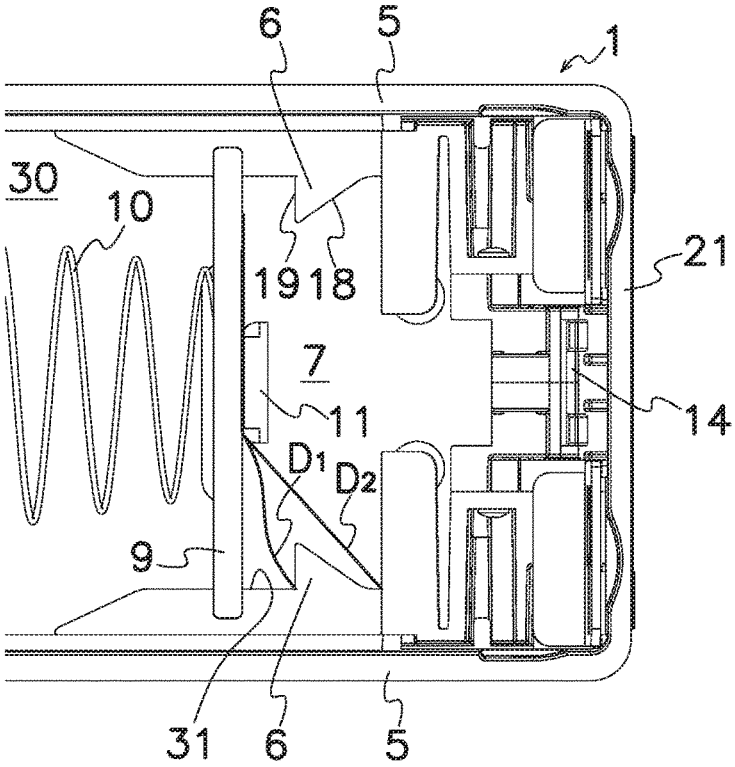
FIG. 9 A sectional view with the pusher on the way to the initial position.
Figure 10:
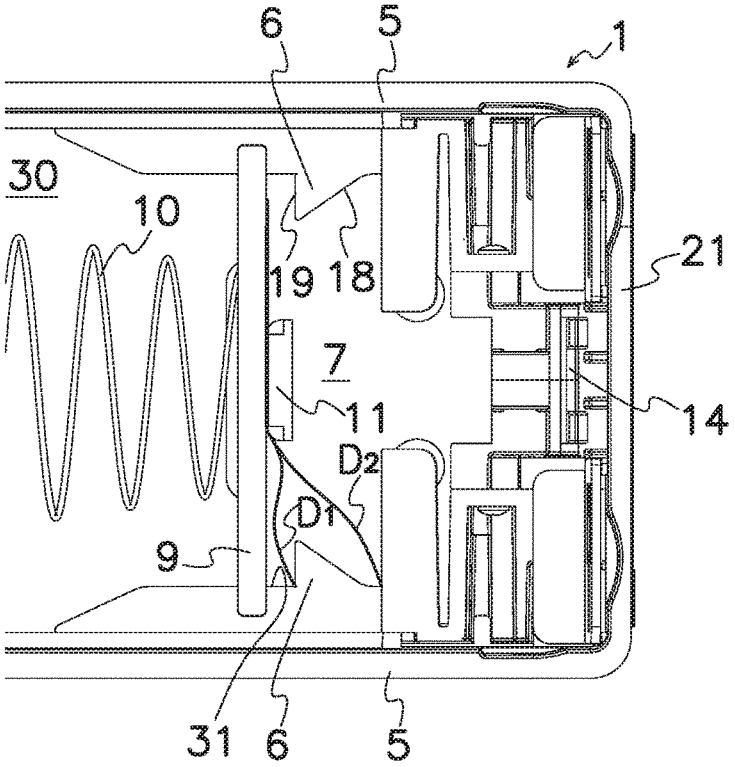
FIG. 10 A sectional view with the pusher of FIG. 9 further on the way to the initial position.

At the moment, a side surface 31 in vault 30 pushes inward the other side edge of first bill $D_1$ gripped between pusher 11 and backup plate 9 to deform the inside of first bill $D_1$ into a curve or bend as shown in FIGS. 9 and 10, and curved first bill $D_1$ stores an inner resilient or restoring force to try to return it to the flatness. When the restoring force becomes greater than frictional force of first bill $D_1$ with backup plate 9 or pusher 11, it makes the one side edge of first bill $D_1$ slide into gaps between backup plate 9 and pusher 11 and between backup plate 9 and support surface 19 on projection 6 to release the restoring force in first bill $D_1$.

Figure 11:
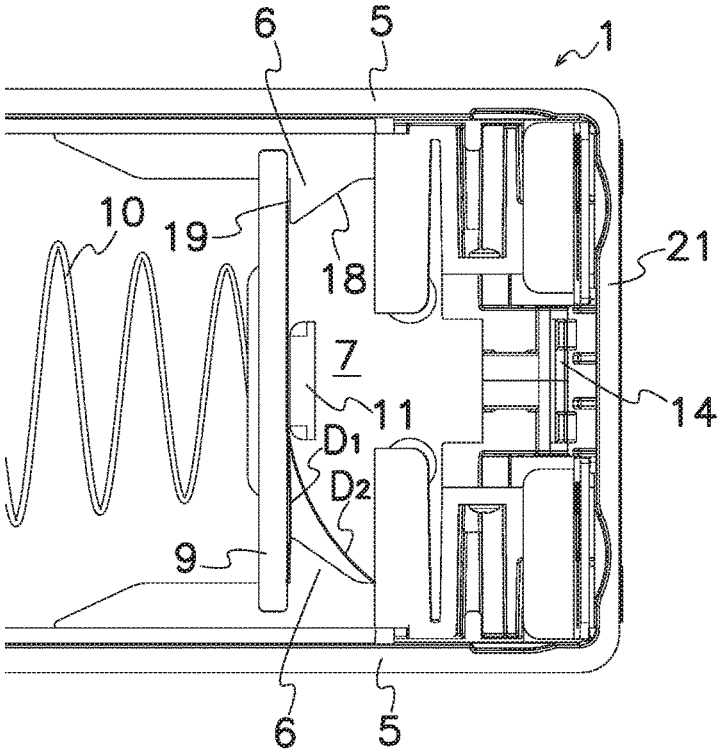
FIG. 11 A sectional view with the pusher returned from FIG. 10 toward the initial position with a backup plate rested on a pair of protrusions prominent from side walls.
Figure 12:
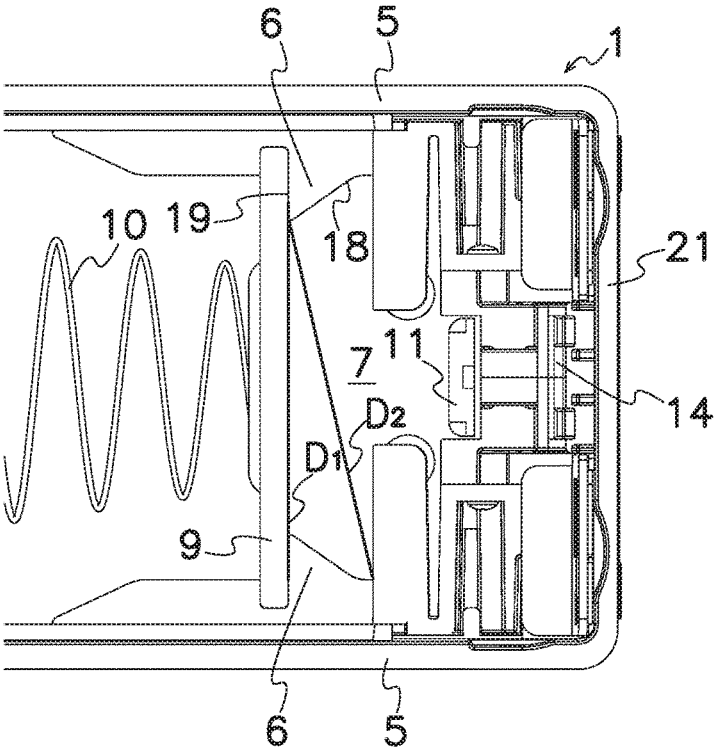
FIG. 12 A sectional view with the pusher in FIG. 11 fully returned to the initial position.
Figure 13:
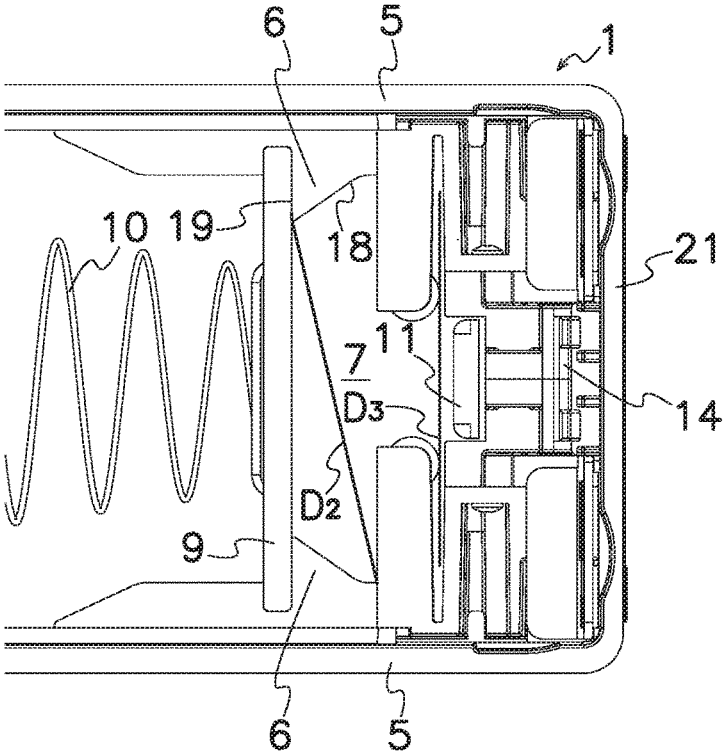
FIG. 13 A sectional view with a subsequent bill arranged in the holding chamber.
Figure 14:
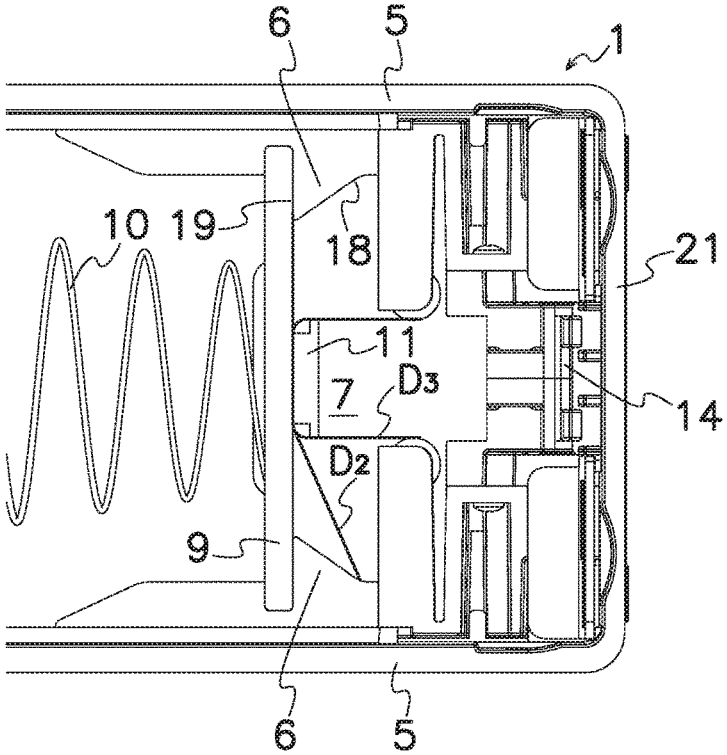
FIG. 14 A sectional view with the pusher in FIG. 13 moved toward the pushed position.
Figure 15:
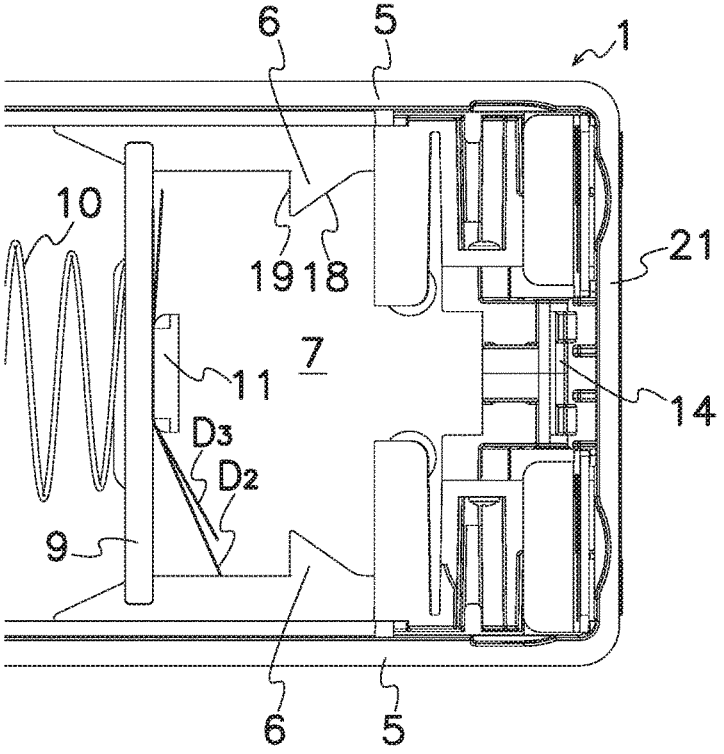
FIG. 15 A sectional view with the pusher in FIG. 14 moved to the pushed position.
Figure 16:
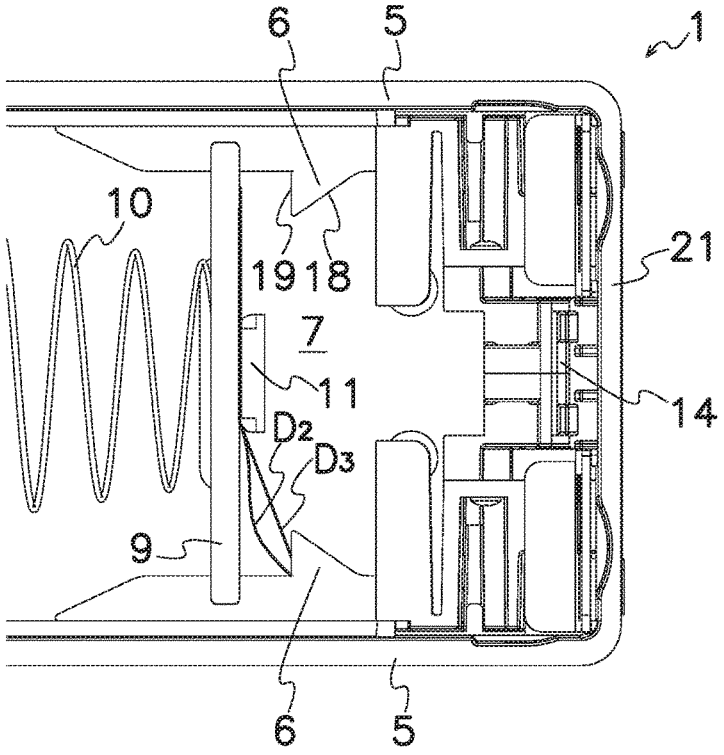
FIG. 16 A sectional view with the pusher in FIG. 15 on the way to the initial position.
Figure 17:
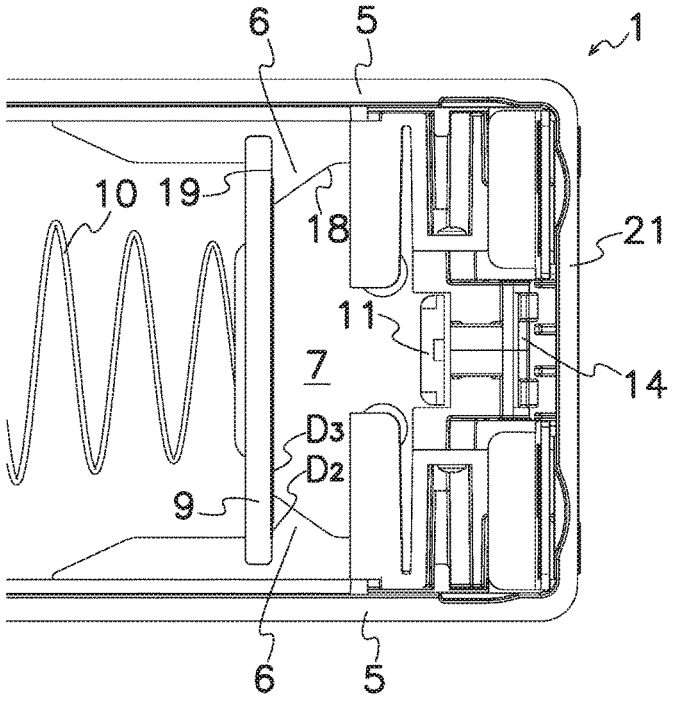
FIG. 17 A sectional view with the pusher in FIG. 16 fully returned to the initial position.
Figure 18:
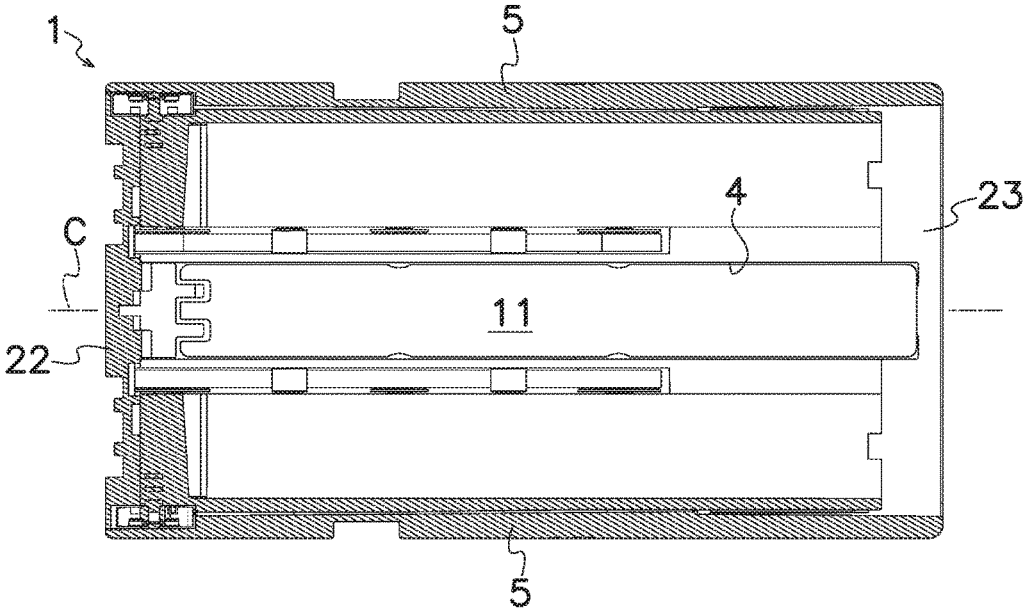
FIG. 18 A horizontal sectional view of the stacker with the pusher in the initial position and holding chamber.
Figure 19:
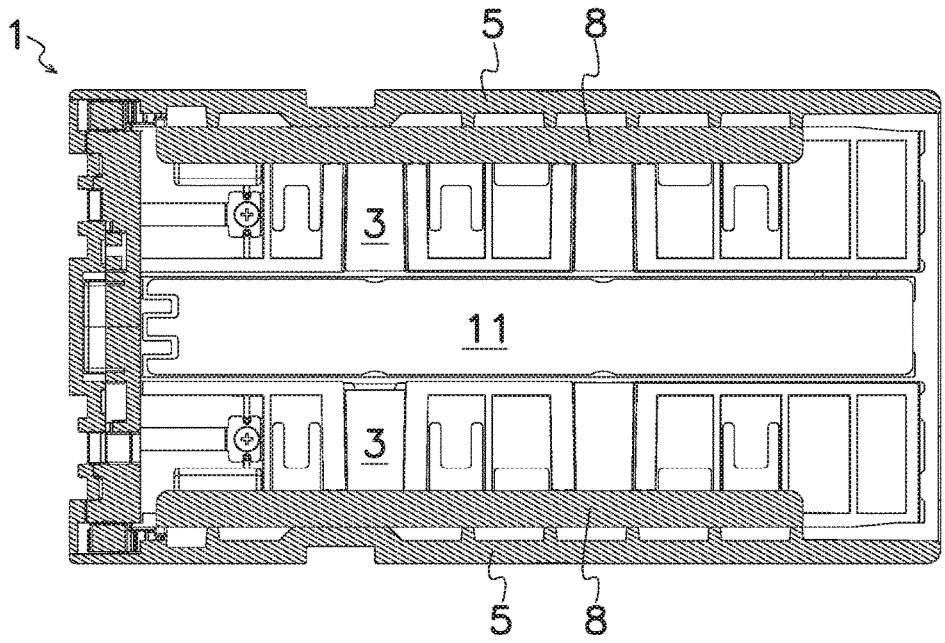
FIG. 19 A horizontal sectional view of the stacker with the interim chamber.
Figure 20:
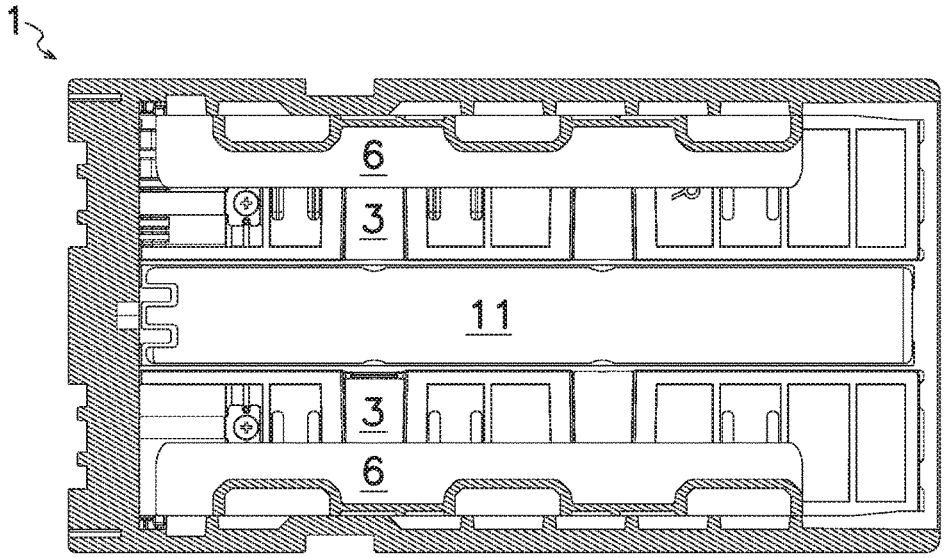
FIG. 20 A horizontal sectional view of the stacker with the vault.

First bill $D_1$ is sandwiched between backup plate 9 and pusher 11 as shown in FIG. 10, and then, FIGS. 11 and 12 show first bill $D_1$ that has opposite side edges securely sandwiched between support surfaces 19 on projections 6 and backup plate 9. In this way, even if first bill $D_1$ is largely deviated in holding chamber 12, it may be stowed in position within vault 30 with tolerable deviation through two services or reciprocations of pusher 11 by actuator 14 between the initial and pushed positions.

When a subsequent second bill $D_2$ is disposed in holding chamber 12 with second bill $D_2$ in alignment with or little deviated from the longitudinal central surface C of case 1, actuator 14 is operated to move pusher 11 to the pushed position in vault 30 so that whole of subsequent second bill $D_2$ and its side edges can pass at one time through all of first opening 4, interim chamber 13 and second opening 7 completely avoiding the states in FIGS. 2 to 5. Then, when pusher 11 is returned to the initial position, first and second bills $D_1$, $D_2$ may be simultaneously positioned between projections 6 and backup plate 9 together with their opposite edges.

When a subsequent second bill $D_2$ is largely deviated in holding chamber 12, second bill $D_2$ will also lead to be arranged in a half-stored state as mentioned above with regard to FIG. 5, but, second bill $D_2$ may certainly be stowed between projections 6 and backup plate 9 upon stowage of a subsequent third bill $D_3$. An operator can take out all bills $D_2$, $D_2$, $D_3$ stowed in position within vault 30 with allowable eccentricity.

In this way, when bill D is disposed in holding chamber 12 with bill D in alignment with or slightly decentered off the longitudinal central surface C of holding chamber 12, the invention may properly stow bill D between protrusions 6 and backup plate 9 from holding chamber 12 into vault 30 through first opening 4, interim chamber 13 and second opening 7 by a single reciprocation of pusher 11 driven by actuator 14 between the initial and pushed positions.

Even though one reciprocation of pusher 11 between the initial and pushed positions fails to properly stow bill D in vault 30, one of bill's side edges comes into contact to a nearby prominent inner surface 8 of protrusion 6 that may reduce departure of bill's central axis with the longitudinal central surface C. This ensures that the second reciprocation of pusher 11 may certainly stow bill D in vault 30 with tolerable deviation for an operator to easily and surely take out a stack of bills from vault 30. Thus, even though bill D is largely decentered in holding chamber 12, projecting inner surface 8 may move inward bill's departing side edge to fully stow whole of bill D into vault 30 upon stowage of a subsequent bill D.

The foregoing embodiments of the invention may be modified or changed in various ways. Shown embodiments illustrate side surfaces 31 of vault 30 that are arranged at the substantially same inner position as those of inner surfaces 8 in interim chamber 13. Side surfaces 31 of vault 30 may be arranged more inward than outmost inner surfaces of inner surfaces 8 in interim chamber 13 to dispose bill D more inward in vault 30 with the central axis of bill D being closer to or in alignment with the longitudinal central surface C of case 1 when pusher 11 stacks bill D into vault 30 from interim chamber 13.

The foregoing embodiments show a single interim chamber 13 defined before a pair of partitions 3, instead, they may provide a plurality of interim chambers 13 before partitions 3 to reduce bill's deviation from the longitudinal central surface C of case 1 through a plurality of continuous reciprocating operations of pusher 11 to stack bills into vault 30.

APPLICABILITY IN INDUSTRY

The invention is applicable to document stackers for storing documents with tolerable deviation.

EXPLANATION OF SYMBOLS (1) . . . a case, (3) . . . partitions, (4) . . . a first opening, (5) . . . side walls, (6) . . . protrusions, (7) . . . a second opening, (8) . . . inner surfaces, (9) . . . a backup plate, (10) . . . a spring, (11) . . . a pusher, (12) . . . a holding chamber, (14) . . . an actuator, (18) . . . tapered surfaces, (19) . . . a support surface, (30) . . . a vault, (C) . . . a longitudinal central surface, (D) . . . a bill (a document).

The invention claimed:

1. A stacker for storing documents comprising:

a case having a pair of side walls, a pair of partitions secured to the side walls in a spaced relation to each other to form a first opening between the partitions, a holding chamber defined behind the partitions, a vault defined between the side walls and before the partitions, a pusher movable between an initial position behind the holding chamber and a pushed position in the vault, an actuator driven for moving the pusher between the initial and pushed positions, a backup plate movably received in the vault, a pair of protrusions prominent from the side walls in a spaced relation to each other to form a second opening between the protrusions, a spring disposed in the vault for resiliently urging the backup plate toward the protrusions, an interim chamber defined by the partitions and protrusions, and a pair of inner surfaces formed on the protrusions prominent into the interim chamber from the side walls more inward than side surfaces of the holding chamber, wherein the actuator is driven to move the pusher from the initial to the pushed position to stow a document from the holding chamber into the vault through the holding chamber, first opening, interim chamber and second opening and to sandwich the document between the protrusions and backup plate.

2. The stacker of claim 1, wherein the inner surfaces have a pair of tapered surfaces converging toward the vault.

3. The stacker of claim 2, wherein all of the holding chamber, first opening, interim chamber and second opening are formed in a mirror image symmetry with respect to a longitudinal central surface of the case and arranged in a line along the moving direction of the pusher.

4. The stacker of claim 1, wherein all of the holding chamber, first opening, interim chamber and second opening are formed in a mirror image symmetry with respect to a longitudinal central surface of the case and arranged in a line along the moving direction of the pusher.

5. The stacker of claim 1, wherein the second opening has a greater width than that of the first opening.

6. The stacker of claim 1, wherein when the document is disposed in the holding chamber in a condition that a central axis of the document is in alignment with or slightly deviated from a longitudinal central surface in the case, whole of the document with its side edges passes at a time through all of the first opening, interim chamber and second opening upon movement of the pusher to the pushed position by the actuator, and when the pusher is returned to the initial position, the both side edges of the document are held between the projections and backup plate.

7. The stacker of claim 1, wherein when the document is disposed in the holding chamber in a condition that a central axis of the document is considerably deviated from a longitudinal central surface in the case, only one side edge of the document near the longitudinal central surface passes through the first opening, interim chamber and second opening upon movement of the pusher to the pushed position by the actuator, another side edge of the document off the longitudinal central surface does not pass through the second opening upon movement of the pusher to the pushed position by the actuator, when the pusher is returned to the initial position, the one side edge of the document is sandwiched between the projection and backup plate, and the other side edge of the document stays in the interim chamber while is moved inward by the inner surface to establish a half-stored state where the one side edge of the document is sandwiched between the projection and the backup plate.

8. The stacker of claim 7, wherein the document is in the half-stored state, when the actuator again moves the pusher toward the pushed position from the initial position, the other side edge of the document passes through the second opening, and then, the return movement of the pusher to the initial position allows the other side edge of the document to also be sandwiched between the projection and backup plate.

9. The stacker of claim 8, wherein the document is in the half-stored state, one of the side surfaces of the vault pushes the other side edge of the document inward to deform an inside of the document into a curve or bend so that the document stores an inner resilient or restoring force to try to return to the flatness, and the restoring force within the document makes the one side edge of the document slide into gaps between the backup plate and pusher and between the backup plate and a support surface on the projection.

10. The stacker of claim 1, wherein the pair of the inner surfaces in the interim chamber has outmost inner surfaces, the vault has side surfaces that are arranged at a more inward position than the outmost inner surfaces in the interim chamber.

* * * * *